US008408612B2

(12) United States Patent
Jankowski et al.

(10) Patent No.: US 8,408,612 B2
(45) Date of Patent: Apr. 2, 2013

(54) ROTARY LOCKING MECHANISM FOR OUTSIDE VEHICLE DOOR HANDLE

(75) Inventors: Krystof P. Jankowski, Waterford, MI (US); Ehab Khalid Kamal, Novi, MI (US)

(73) Assignee: Intier Automotive Closures Inc, Newmarket, Ontario (CA)

( * ) Notice: Subject to any disclaimer, the term of this patent is extended or adjusted under 35 U.S.C. 154(b) by 325 days.

(21) Appl. No.: 12/657,883

(22) Filed: May 27, 2010

(65) Prior Publication Data

US 2010/0237633 A1 Sep. 23, 2010

Related U.S. Application Data

(63) Continuation-in-part of application No. 11/578,033, filed as application No. PCT/CA2005/000662 on May 2, 2005, now Pat. No. 7,686, 355.

(60) Provisional application No. 60/566,980, filed on Apr. 30, 2004.

(51) Int. Cl.
*E05B 3/00* (2006.01)
*E05C 3/06* (2006.01)

(52) U.S. Cl. ..... 292/336.3; 292/216

(58) Field of Classification Search ..... 292/336.3, 292/216, DIG. 22, DIG. 65
See application file for complete search history.

(56) References Cited

U.S. PATENT DOCUMENTS 4,177,962 A 12/1979 Hildebrandt
5,669,642 A * 9/1997 Kang ..... 292/336.3
5,931,402 A 8/1999 Weller
6,042,159 A * 3/2000 Spitzley et al. ..... 292/216
6,062,613 A * 5/2000 Jung et al. ..... 292/201
6,113,161 A * 9/2000 Jung et al. ..... 292/216
6,209,932 B1 * 4/2001 Jung et al. ..... 292/216
6,241,294 B1 6/2001 Young et al.
6,343,760 B1 2/2002 Smithson
6,447,030 B1 9/2002 Meinke
6,464,270 B1 10/2002 Sloan et al.
6,648,382 B1 11/2003 Monig et al.

(Continued)

FOREIGN PATENT DOCUMENTS

DE 19858416 6/2000
DE 199 01 279 A1 7/2000

(Continued)

OTHER PUBLICATIONS

European Search Report Dated Mar. 3, 2010.

*Primary Examiner* — Thomas Beach
*Assistant Examiner* — Nathan Cumar
(74) *Attorney, Agent, or Firm* — Miller Canfield

(57) ABSTRACT

A locking device for a handle assembly of a motor vehicle door including a base and a handle portion includes a lock cup fixedly secured to the base and having a plurality of teeth. A spool is rotatably coupled to the lock cup and operably connected to the handle portion. The spool has a pawl rotatably mounted thereto and includes a pawl pin extending out therefrom. An inertia element is disposed within the lock cup and is rotatable out of a rest position upon rotation of the spool. The inertia element includes an elongated slot extending between first and second ends for receiving the pawl pin therewithin. A spring extends between the spool and the inertia element. The spring biases the inertia element towards the rest position.

26 Claims, 14 Drawing Sheets

U.S. PATENT DOCUMENTS

| | | | | |
|---|---|---|---|---|
| 6,942,260 | B2 * | 9/2005 | Bucker et al. | 292/336.3 |
| 7,029,042 | B2 * | 4/2006 | Belchine, III | 292/336.3 |
| 7,163,240 | B2 * | 1/2007 | Odahara | 292/347 |
| 7,481,468 | B2 * | 1/2009 | Merideth et al. | 292/137 |
| 2006/0131892 | A1 * | 6/2006 | Pereverzev | 292/216 |
| 2006/0237973 | A1 * | 10/2006 | Anguila | 292/92 |
| 2006/0261602 | A1 * | 11/2006 | Jankowski et al. | 292/216 |
| 2006/0261603 | A1 * | 11/2006 | Cetnar et al. | 292/216 |
| 2007/0085349 | A1 * | 4/2007 | Merideth et al. | 292/183 |
| 2008/0036219 | A1 * | 2/2008 | Savant et al. | 292/336.3 |
| 2009/0044378 | A1 * | 2/2009 | Jankowski et al. | 16/412 |

FOREIGN PATENT DOCUMENTS

| | | | |
|---|---|---|---|
| DE | 101 14 965 | A1 | 10/2002 |
| EP | 1 010 846 | A1 | 6/2000 |
| EP | 1 371 799 | A2 | 12/2003 |
| EP | 1 375 794 | A2 | 1/2004 |
| WO | WO 02/14636 | A1 | 2/2002 |

* cited by examiner

ROTARY LOCKING MECHANISM FOR OUTSIDE VEHICLE DOOR HANDLE

CROSS-REFERENCE TO RELATED APPLICATIONS

This application is a continuation-in-part of prior U.S. application Ser. No. 11/578,033, filed Oct. 12, 2006, which was the National Stage of International Application No. PCT/CA05/00662, filed May 2, 2005, which claims the benefit of U.S. Provisional Application No. 60/566,980, filed on Apr. 30, 2004.

FIELD OF THE INVENTION

The invention relates to a handle assembly for a motor vehicle. More particularly, the invention relates to a locking device for preventing a motor vehicle door from opening when a handle portion of a handle assembly moves with acceleration above a predetermined threshold.

DESCRIPTION OF THE RELATED ART

Motor vehicles include at least one outside door handle for releasing a door latch mechanism in order to open a door. Typically, a user actuates the outside door handle by pivoting a handle portion relative to a base. The handle portion may, however, also be pivoted relative to the base when the outside door handle is exposed to a high inertia force or sheet metal buckling, such as may occur during a motor vehicle impact. This pivoting of the handle portion in response to the high inertia force or sheet metal buckling can cause inadvertent opening of the door, which is undesirable.

It is also appreciated that various components other than the outside door handle may move with acceleration above a predetermined threshold in response to an impact force, and such movement may also cause the door to open. For example, any of numerous motor vehicle doors, including side, rear, and sliding doors, can move with acceleration above a predetermined threshold during a motor vehicle impact, which causes a ratchet to release a striker so that the door opens inadvertently.

Further, a door latch is also subject to inadvertently releasing a striker when an element thereof moves with acceleration higher than a predetermined threshold as a result of an impact force. Such movement may be the result of an inertia force acting on latch elements, forced motion of an inside door handle or cable, or forced motion of the outside door handle or connecting rod.

SUMMARY

According to one aspect of the invention, a locking device is provided for a handle assembly of a motor vehicle door including a base and a handle portion. The locking device includes a lock cup fixedly secured to the base and having a plurality of teeth. A spool is rotatably coupled to the lock cup and is operably connected to the handle portion. The spool has a pawl rotatably mounted thereto. The pawl includes a pawl pin extending out therefrom. An inertia element is disposed within the lock cup and rotatable out of a rest position upon rotation of the spool. The inertia element includes an elongated slot extending between first and second ends for receiving the pawl pin therewithin. A spring extends between the spool and the inertia element. The spring biases the inertia element towards the rest position. Upon acceleration of the handle assembly below a predetermined threshold the inertia element rotates with the spool and the handle portion moves relative to the base to allow opening of the door, and upon acceleration of the handle assembly above the predetermined threshold the inertia element lags rotation of the spool and forces the pawl pin to the second end of the elongated slot to urge the pawl into engagement with one of the plurality of teeth on the lock cup to stop movement of the handle portion relative to the base and prevent the door from opening.

According to another aspect of the invention, a handle assembly is provided for actuating a door latch mechanism of a motor vehicle door. The handle assembly includes a base adapted to be fixedly secured to the door, and a handle portion pivotally secured to the base and operatively connected to the door latch mechanism. A lock cup is fixedly secured to the base and has a plurality of teeth. A spool is rotatably coupled to the lock cup and operably connected to the handle portion. The spool has a pawl rotatably mounted thereto. The pawl pin includes a pawl pin extending therefrom. An inertia element is disposed within the lock cup and is rotatable out of a rest position upon rotation of the spool. The inertia element includes an elongated slot extending between first and second ends for receiving the pawl pin therewithin. A spring extends between the spool and the inertia element and biases the inertia element towards the rest position. Upon acceleration of the handle portion below a predetermined threshold the inertia element rotates with the spool and the pawl remains spaced apart from the second end of the elongated slot such that the handle portion moves relative to the base and the door latch mechanism is released. Upon acceleration of the handle portion above the predetermined threshold the inertia element lags rotation of the spool and forces the pawl to the second end of the elongated slot into engagement with one of the plurality of teeth to stop movement of the handle portion relative to the base and prevents the door from opening.

According to yet another aspect of the invention, a locking device is provided for selectively preventing a fork rotatably mounted to a base from releasing a bolt upon movement of a door. The locking device includes a plurality of teeth fixedly secured to the base adjacent the fork, and a pawl rotatably mounted to the fork and having an engaging portion. The pawl includes a pawl pin extending out therefrom. An inertia element is rotatable out of a rest position upon rotation of the fork. The inertia element includes an elongated slot extending between a first end and a second end for receiving the pawl pin therewithin. A spring extends between the inertia element and the fork for biasing the inertia element towards the rest position. Upon acceleration of the door below a predetermined threshold the inertia element rotates with the fork to allow the fork to release the bolt. And upon the acceleration of the door above the predetermined threshold rotation of the inertia element lags behind rotation of the fork such that the pawl pin moves to the second end of the elongated slot to urge the engaging portion of the pawl into engagement with one of the plurality of teeth to prevent the fork from releasing the bolt.

According to another aspect of the invention, a door latch includes a base, a ratchet rotatably mounted to the base and selectively retaining a striker, latch pawl rotatably mounted to the base and selectively engaging the ratchet, and a plurality of teeth fixedly secured to the base. A pawl is rotatably mounted to the latch pawl. The pawl includes a pawl pin extending out therefrom. An inertia element is rotatably coupled to the pawl for movement from a rest position. The inertia element includes an elongated slot extending between first and second ends for receiving the pawl pin therewithin. A spring extends between the latch pawl and the inertia element for biasing the inertia element into the rest position. Upon acceleration of the latch pawl below a predetermined threshold the inertia element rotates simultaneously with the latch pawl and the latch pawl releases the ratchet to allow opening of the door and upon acceleration of the latch pawl above the predetermined threshold the inertia element lags rotation of the latch pawl so that the pawl pin moves to the second end of the elongated slot and the pawl engages one of the plurality of teeth to stop movement of the latch pawl and prevent the door from opening.

According to still another aspect of the invention, a latch for retaining a striker includes a base plate, a ratchet rotatably mounted to the base and selectively retaining the striker, a pawl rotatably mounted to the base and movable between an engaged position in engagement with the ratchet and a release position spaced apart from the ratchet to release the striker, and an auxiliary pawl lever operably coupled to the pawl for selectively moving the pawl from the engaged position to the release position. A locking device includes a lock cup fixedly mounted to the base plate and having a plurality of teeth, a spool rotatably mounted to the lock cup, an inertia element rotatable with the spool, and an engagement pawl rotatably mounted between the spool and the inertia element such that upon acceleration of the auxiliary pawl lever below a predetermined threshold the inertia element rotates together with the spool to allow the auxiliary pawl lever to move the pawl from the engaged position to the release position, and upon acceleration of the auxiliary pawl lever above the predetermined threshold the inertia element lags rotation of the spool so that the engagement pawl engages one of the plurality of teeth to stop movement of the auxiliary pawl lever and prevent movement of the pawl from the engaged position to the release position.

According to another aspect of the invention, a locking device for selectively controlling rotational movement of an auxiliary pawl lever includes a lever operably coupled to the auxiliary pawl lever, a lock cup having a peripheral wall and a plurality of teeth disposed along the peripheral wall, a spool coupled to the lever and rotatable relative to the lock cup, the spool defining first and second recesses, the spool including first and second catch pawls received within the first and second recesses and rotatable relative to the spool, each of the first and second catch pawls including a catch pin extending out therefrom. An inertia element is rotatable with the spool. The inertia element includes catch slots each receiving one of the catch pins therewithin such that upon acceleration of the auxiliary pawl lever below a predetermined threshold the inertia element rotates together with the spool to allow the auxiliary pawl lever to move the pawl from the engaged position to the release position, and upon acceleration of the auxiliary pawl lever above the predetermined threshold the inertia element lags rotation of the spool so that the catch pawls engage the plurality of teeth on the lock cup to stop movement of the auxiliary pawl lever and prevent movement of the pawl from the engaged position to the release position.

BRIEF DESCRIPTION OF THE DRAWINGS

Advantages of the present invention will be readily appreciated as the same becomes understood by reference to the following detailed description when considered in connection with the accompanying drawings wherein.

DETAILED DESCRIPTION OF THE EMBODIMENTS

Figure 1:
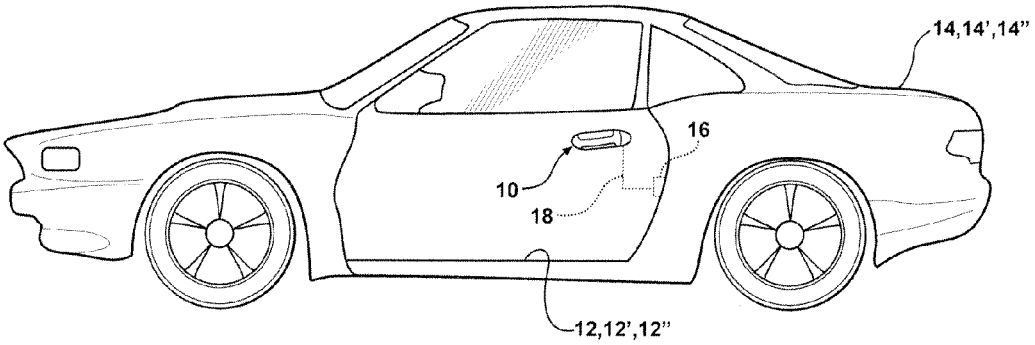
FIG. 1 is a side view of a motor vehicle including a handle assembly.

Referring to FIG. 1, a handle assembly, generally indicated at 10, is mounted along a door 12 of a motor vehicle 14. The handle assembly 10 is operatively connected to a door latch mechanism 16 by a rod 18. When the door latch mechanism 16 is unlocked, the handle assembly 10 may be actuated from outside the motor vehicle 14 to release the door latch mechanism 16 and open the door 12.

Figure 2:
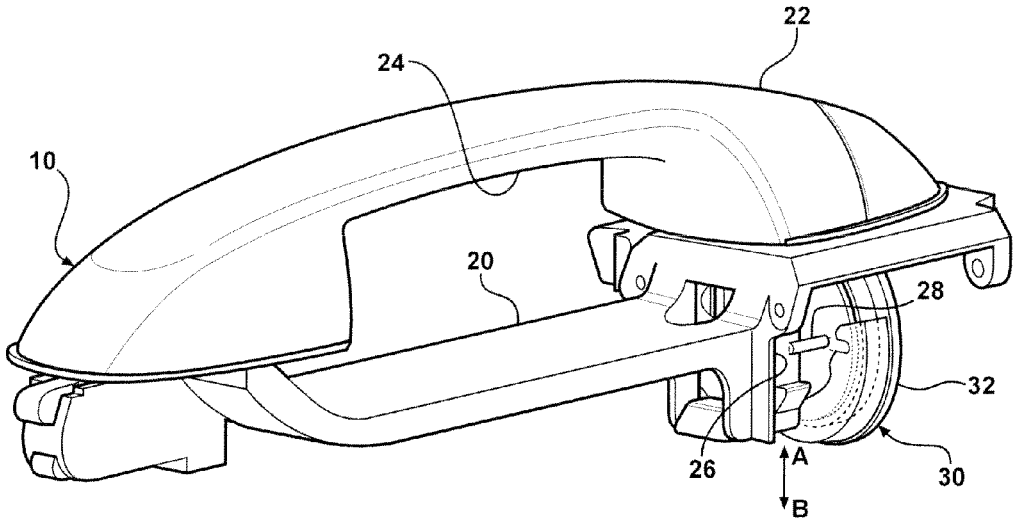
FIG. 2 is a perspective view of the handle assembly including a locking device according to a first embodiment of the invention.
Figure 3:
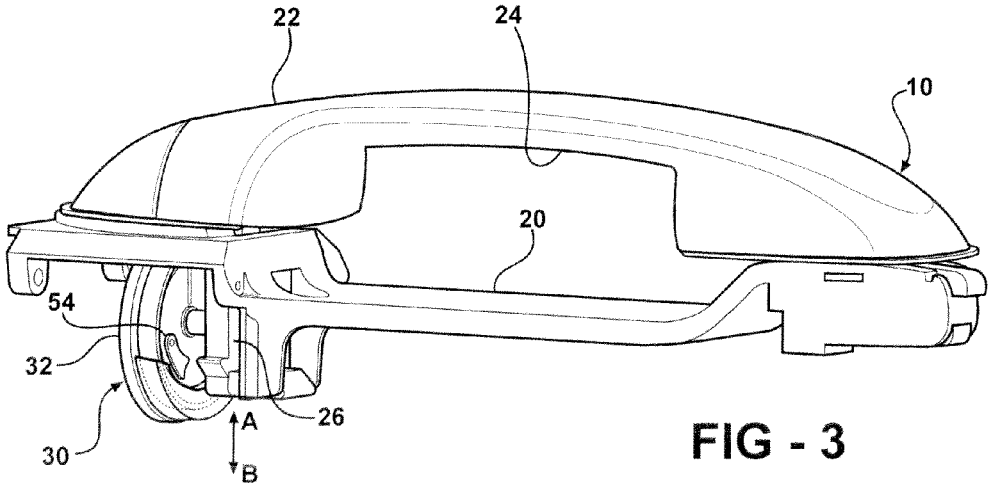
FIG. 3 is an opposing perspective view of the handle assembly including the locking device.

Referring to FIGS. 2 and 3, the handle assembly 10 includes a base 20 adapted to be fixedly secured to the door 12. A handle portion 22 is pivotally coupled to the base 20. The handle portion 22 includes a grip 24 that is manually grasped by a user for pivoting the handle portion 22 relative to the base 20 in order to actuate the handle assembly 10.

The handle assembly 10 also includes a handle lever 26 extending out from the handle portion 22. The handle lever 26 moves axially towards and away from the base 20, in the direction of arrows A and B, as the handle portion 22 is pivoted relative to the base 20. The handle lever 26 is also operably connected to the door latch mechanism 16. More specifically, the movement of the handle lever 26 in the direction of arrow A as the handle portion 22 is pivoted releases the door latch mechanism 16. A pin 28 extends outwardly from the handle lever 26 and moves axially therewith in the direction of arrows A and B as the handle portion 22 is pivoted relative to the base 20. The pin 28 terminates at a distal end 29, as shown in FIG. 4.

Referring now to FIGS. 2 through 5, a rotary catch or locking device, generally indicated at 30, is provided for preventing inadvertent release of the door latch mechanism 16 when an impact originated force causes the handle portion 22 to move with acceleration above a predetermined threshold relative to the base 20. The locking device 30 includes a lock cup 32 fixedly secured to the base 20. In a preferred embodiment, the lock cup 32 is generally cylindrical. It is, however, appreciated that the particular shape of the lock cup 32 may vary.

Figure 4:
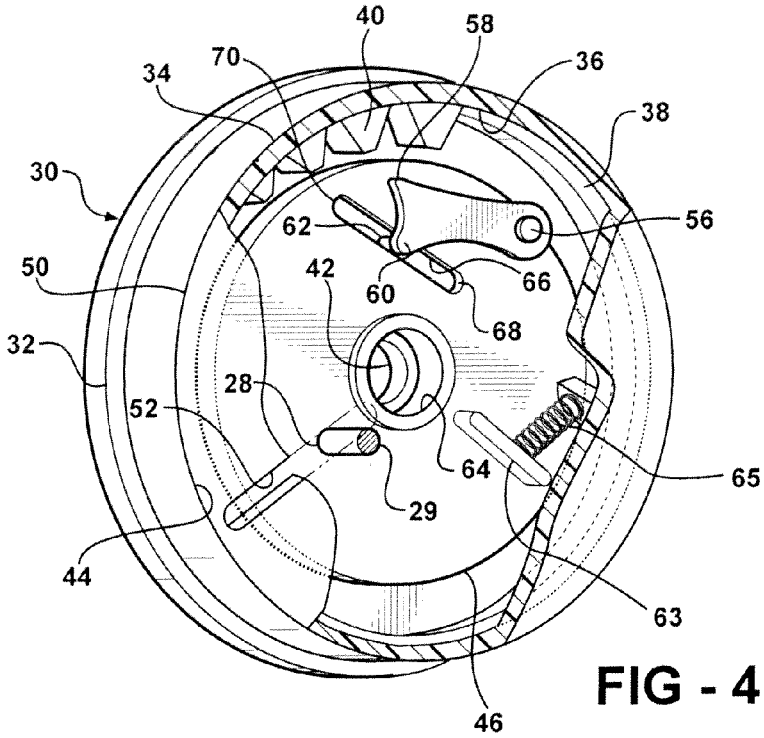
FIG. 4 is a perspective view, partially cut-away, of the locking device including a lock cup, spool and inertia element.

Referring specifically to FIG. 4, the lock cup 32 includes a peripheral wall 34 defining an opening 36. The peripheral wall 34 includes an inner surface 38 having a plurality of teeth 40 positioned therealong. In the preferred embodiment, the peripheral wall 34 is circular, thereby creating a circle-shaped opening 36. It is, however, appreciated that the particular shape of the peripheral wall 34 may vary. The lock cup 32 further includes a center bore 42.

Figure 5:
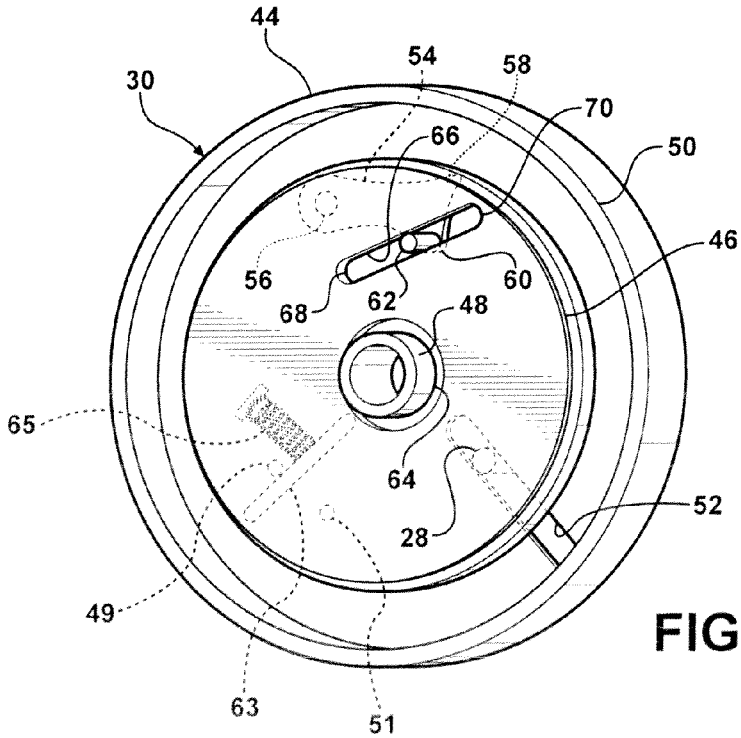
FIG. 5 is a perspective view of the spool with the inertia element coupled thereto.

Referring now to FIGS. 4 and 5, the locking device 30 also includes a spool 44. The spool 44 has a central hub 48 that is disposed within the center bore 42 of the lock cup 32 to allow for rotation of the spool 44 relative thereto. The spool 44 also includes an annular wall 50 that fits around the peripheral wall 34 of the lock cup 32. The spool 44 further includes a slot 52 for receiving the pin 28 extending out from the handle lever 26. First 49 and second 51 stops are spaced apart from one another along the spool 44.

Figure 7:
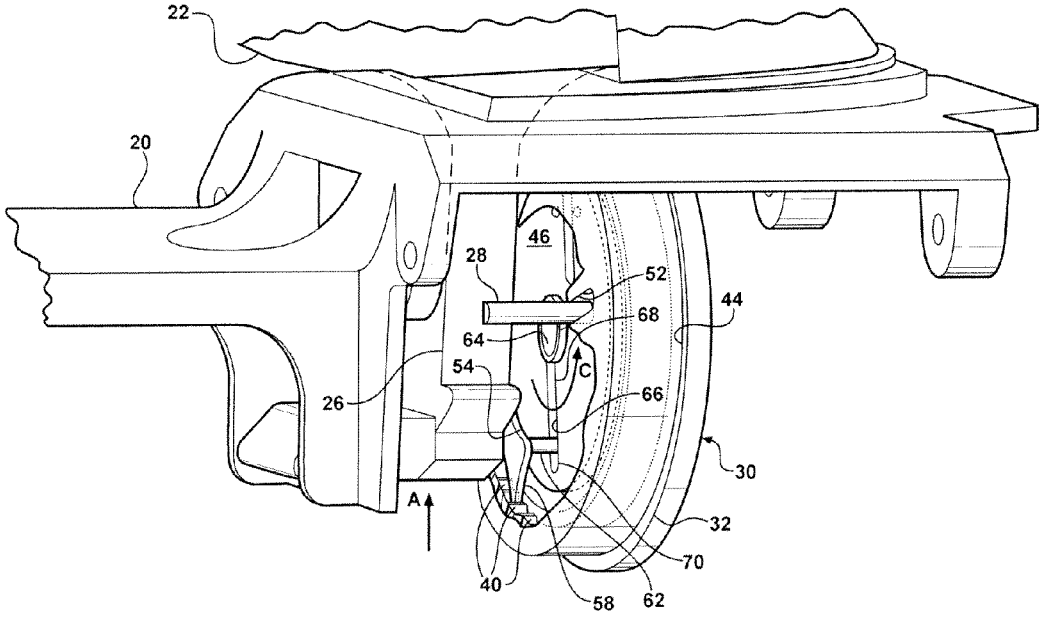
FIG. 7 is a fragmentary, perspective view of the handle assembly with a pawl engaging a plurality of teeth along the lock cup.

When the handle portion 22 is pivoted away from the base 20, the handle lever 26, and the pin 28 extending outwardly therefrom, move axially towards the base 20 in the direction of arrow A, as shown in FIG. 7. The axial movement of the pin 28 urges the spool 44 to rotate counterclockwise in the direction of arrow C, as shown in FIG. 7, relative to the lock cup 32. Thus, the axial movement of the handle lever 26 is translated into rotational movement of the spool 44.

Referring once again to FIGS. 4 and 5, a pawl 54 is rotatably mounted to the spool 44 by a mounting pin 56. The pawl 54 includes an engaging portion 58 and a coupling portion 60. A pawl pin 62 extends out from the coupling portion 60.

The locking device 30 further includes an inertia element 46. The inertia element 46 may have any one of various shapes. The inertia element 46 is disposed between the lock cup 32 and the spool 44. More specifically, the inertia element 46 is sized to fit inside the opening 36 defined by the peripheral wall 34 of the lock cup 32. The inertia element 46 also includes an abutment member 63 fixedly secured thereto and extending out therefrom for selectively abutting the first 49 and second 51 stops on the spool 44. The first 49 and second 51 stops limit motion of the inertia element 46 relative to the spool 44. A spring 65 includes one end secured to the inertia element 46 and an opposite end secured to the spool 44. The spring 65 is preloaded and biases the inertia element 46 to a rest position in which the abutment member 63 abuts the first stop 49 on the spool 44, as shown in FIG. 5.

The inertia element 46 also includes a central aperture 64 for receiving the central hub 48 of the spool 44 therethrough. Thus, the inertia element 46 is able to rotate with the spool 44 relative to the lock cup 32 when the handle portion 22 is pivoted relative to the base 20. During normal operation, i.e., when the handle portion 22 is actuated by a user, the inertia element 46 and the spool 44 rotate simultaneously. By contrast, when the handle portion 22 moves with acceleration above the predetermined threshold, such as may occur during a motor vehicle impact, rotation of the inertia element 46 lags behind the rotation of the spool 44.

The inertia element 46 further includes an elongated slot 66 having first 68 and second 70 ends. The pawl pin 62 is received within the elongated slot 66 and is movable between first 68 and second 70 ends thereof. More specifically, when the handle portion 22 moves with acceleration above the predetermined threshold, the pawl pin 62 moves towards the second end 70 of the elongated slot 66, as shown in FIG. 7, thereby urging the engaging portion 58 of the pawl 54 into engagement with one of the plurality of teeth 40 along the peripheral wall 34 of the lock cup 32. As a result of this engagement, rotation of the spool 44 relative to the lock cup 32 is stopped, thereby blocking further axial movement of the pin 28. Thus, the handle portion 22 is prevented from fully pivoting relative to the base 20 and releasing the door latch mechanism 16. As a result, the door 12 will not open.

Figure 6:
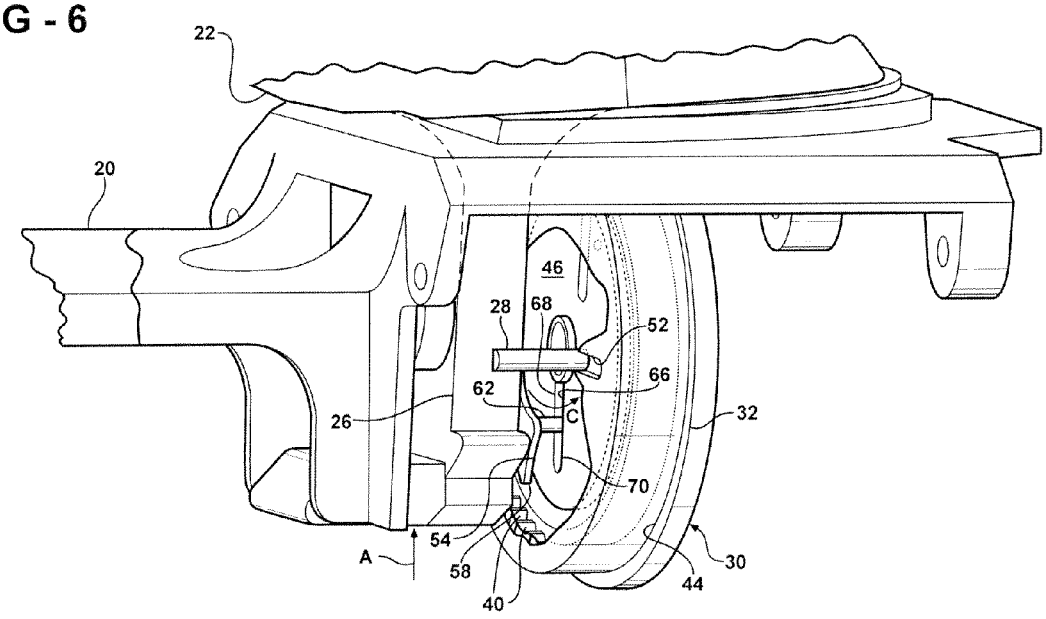
FIG. 6 is fragmentary, perspective view of the handle assembly including the locking device.

In operation, when the handle assembly 10 moves with acceleration below the predetermined threshold, such as would occur during normal operation when a user actuates the handle assembly 10 by pivoting the handle portion 22 relative to the base 20, the handle portion 22 will fully pivot relative to the base 20 to release the door latch mechanism 16 and open the door 14. In such a situation, the pivoting of the handle portion 22 relative to the base 20 causes the handle lever 26, and the pin 28 extending therefrom, to move axially in the direction of arrow A, as shown in FIG. 6. As the pin 28 moves axially, it urges the spool 44 to rotate counterclockwise in the direction of arrow C, when viewed from FIG. 6. The inertia element 46 simultaneously rotates with the spool 44 in the counterclockwise direction. Because of the simultaneous rotation of the spool 44 and inertia element 46, the pawl pin 62 does not move towards the second end 70 of the elongated slot 66, and the engaging portion 58 of the pawl 54 does not engage the plurality of teeth 40. As a result, the handle lever 26 moves axially until the handle portion 22 stops pivoting relative to the base 20, at which time the door latch mechanism 16 is released in order to open the door 12.

On the other hand, when an impact originated force causes the handle assembly 10 to move with acceleration above the predetermined threshold, the handle portion 22 will begin to pivot relative to the base 20. As a result, the handle lever 26 and the pin 28 move axially towards the base 20 in the direction of arrow A, as shown in FIG. 7. As the pin 28 moves axially, it urges the spool 44 to rotate counterclockwise, when viewed from FIG. 7, in the direction of arrow C. The rotation of the inertia element 46 lags, however, behind the rotation of the spool 44. Due to relative rotation of the inertia element 46 with respect to the spool 44, the pawl pin 62 moves towards the second end 70 of the elongated slot 66 and, as a result, the engaging portion 58 of the pawl 54 engages one of the plurality of teeth 40. When the pawl 54 engages one of the plurality of teeth 40, the rotation of the spool 44 is stopped. As a result, further axial movement of the handle lever 26 in the direction of arrow A is prevented and the handle portion 22 can no longer be pivoted relative to the base 20. Consequently, the door latch mechanism 16 is not released and the door 12 does not open.

Figure 8:
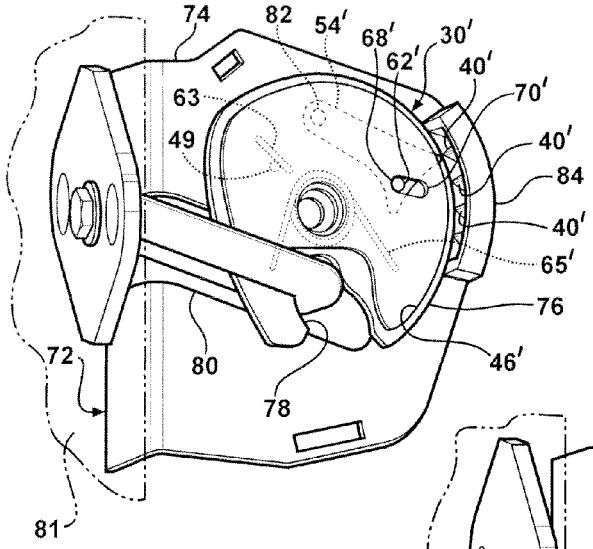
FIG. 8 is a perspective view of a door locking mechanism including a locking device according to a second embodiment of the invention.
Figure 9:
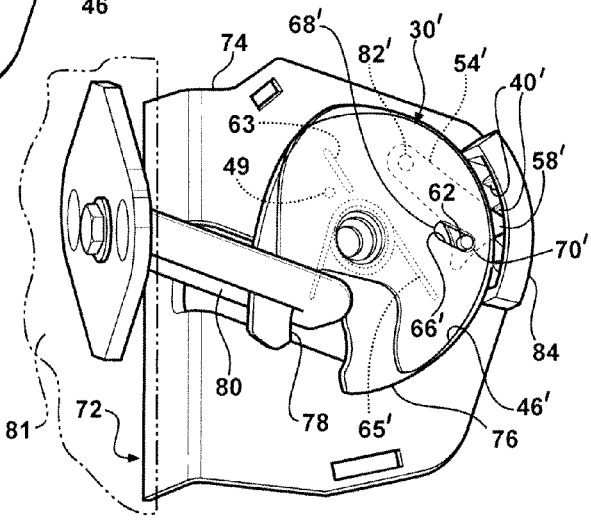
FIG. 9 is a perspective view of the door locking mechanism including the locking device having a pawl engaging one of a plurality of teeth to retain a fork in a locked position.
Figure 10:
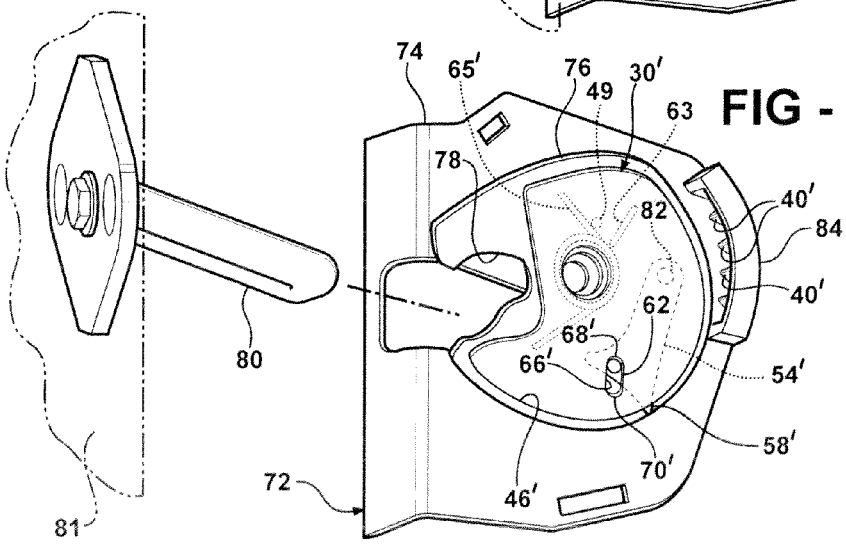
FIG. 10 is a perspective view of the door locking mechanism including the fork in an unlocked position for releasing a bolt.

Referring to FIGS. 8 through 10, wherein like primed reference numerals represent similar elements as those described above, the locking device 30' according to a second embodiment is incorporated into a door locking mechanism, generally indicated at 72. The door locking mechanism 72, which can be associated with a side door, a sliding door, or a rear door, includes a base 74 for mounting to the door 12' of the motor vehicle 14'. A fork 76 is rotatably mounted to the base 74 for movement between a latched position, shown in FIGS. 8 and 9, and an unlatched position, shown in FIG. 10. The fork 76 includes a recess 78 for receiving a bolt 80, which is fixedly mounted along a motor vehicle body 81. A spring (not shown) biases the fork 76 into the unlatched position.

The locking device 30' includes the plurality of teeth 40', the inertia element 46', and the pawl 54'. The plurality of teeth 40' is disposed along the base 74 adjacent the fork 76. Preferably, a generally arcuate member 84 is fixedly secured to the base 74 and includes the plurality of teeth 40' extending along a lower portion. The inertia element 46' preferably has an irregular shape that generally corresponds to the shape of the fork 76. It is, however, appreciated that the particular shape of the inertia element 46' may vary. The inertia element 46' includes the abutment member 63' extending out therefrom for engaging the first stop 49 on the fork 76 when the inertia element 46' is in the rest position. The spring 65' extends between the inertia element 46' and the fork 76. The spring 65' preloads the inertia element 46' towards the rest position, that is, the abutment member 63' is biases towards the first stop 49 on the fork 76. The particular characteristics of the spring 65' determines the threshold at which the inertia element 46' is activated.

The pawl 54' is disposed between the inertia element 46' and the fork 76. More specifically, the pawl 54' is rotatably mounted to the fork 76 by the pin 56'. The pawl pin 62' extending outwards from the opposing end of the pawl 54' is received within the elongated slot 66' of the inertia element 46'. The pawl pin 62' moves between the first 68' and second 70' ends of the elongated slot 66' when the inertia element 46' rotates with respect to the fork 76.

In operation, when the door 12' is opened in a typical manner by a user (so that the relative acceleration between the door locking mechanism 72 and the bolt 80 is below the predetermined threshold), the fork 76 rotates clockwise relative to the base 74 in the direction of arrow D, shown in FIG. 8. The inertia element 46' simultaneously rotates with the fork 76 until the fork 76 reaches its unlatched position, shown in FIG. 9. When the fork 76 is in the unlatched position, the bolt 80 is released to allow the door 12' to open.

On the other hand, when the relative acceleration between the door locking mechanism 72 and the bolt 80 is above the pre-determined threshold, such as may occur during a motor vehicle impact, the rotation of the inertia element 46' in the direction of arrow D, shown in FIG. 8, will lag behind that of the fork 76 so that the pawl pin 62' moves toward the second end 70' of the elongated slot 66' and the engaging portion 58' of the pawl 54' engages one of the plurality of teeth 40', as shown in FIG. 10. When the pawl 54' engages one of the plurality of teeth 40', further clockwise rotation of the fork 76 in the direction of arrow D is prevented. As a result, the fork 76 remains in the latched position retaining the bolt 80.

Figure 11:
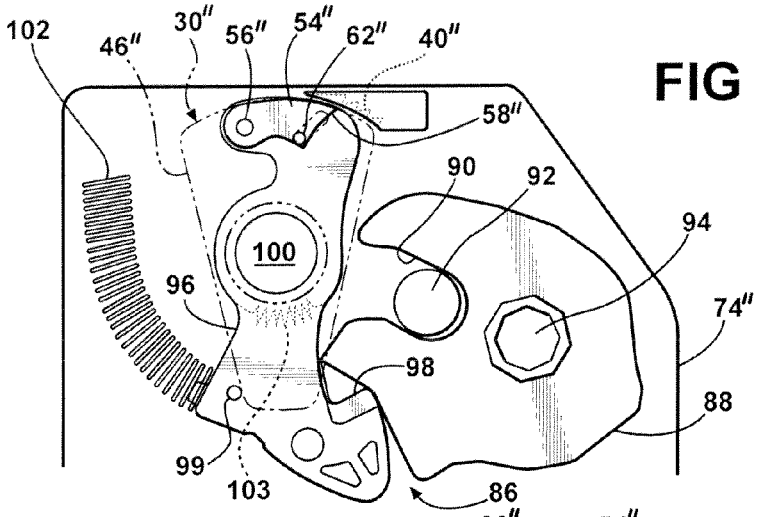
FIG. 11 is a side view of a main door latch including a locking device according to a third embodiment of the invention for selectively preventing a latch pawl from releasing a ratchet.
Figure 12:
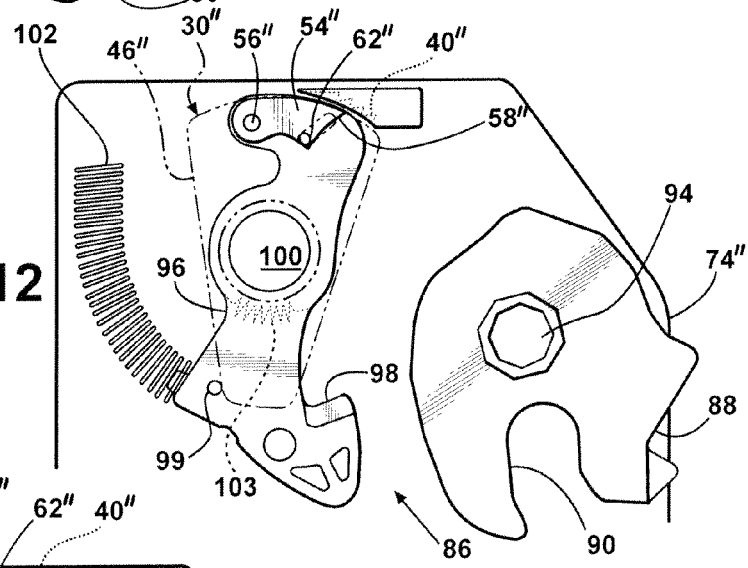
FIG. 12 is a side view of the main door latch including a pawl of the locking device clearing a plurality of teeth to allow rotation of the latch pawl in order to release the ratchet.
Figure 13:
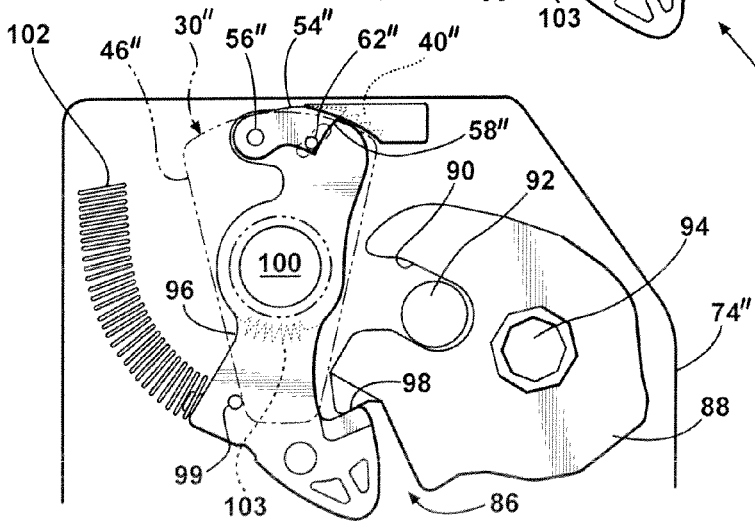
FIG. 13 is a side view of the main door latch including the pawl engaging one of the plurality of teeth to prevent the latch pawl from releasing the ratchet.

Referring to FIGS. 11 through 13, wherein like double primed reference numerals represent similar elements as those described above, the locking device 30" according to a third embodiment can be utilized with a main door latch, generally shown at 86. The main door latch 86 includes a ratchet 88 having a notch 90 for selectively retaining a striker 92. The ratchet 88 is rotatably mounted about a pivot 94.

The main door latch 86 also includes a latch pawl 96, which selectively engages a detent surface 96 of the ratchet 88 to maintain the ratchet 88 in a latched position retaining the striker 92. The latch pawl 98 is rotatably mounted about a pivot pin 100 and is biased into engagement with the ratchet 88 by a spring 102. The latch pawl 96 includes a stop 99 formed therealong. Inside and outside release handles (both not shown) are operably connected to the latch pawl 96 via a cable or rod. Actuation of one of the inside and outside release handles urges the latch pawl 96 against the bias of the spring 102 and out of engagement with the ratchet 88 in order to release the striker 92.

In one embodiment, the inertia element 46" is generally wedge-shaped and is rotatably mounted about the pivot pin 100. The inertia element 46" abuts the stop 99 when the inertia element 46" is in a rest position. A biasing member 103 biases the inertia element 46" towards the rest position. The pawl 54" is disposed between the inertia element 46" and the latch pawl 96. More specifically, the pawl 54" is rotatably mounted to the latch pawl 96 by the pin 56". The pawl pin 62" extending outwards from the opposing end of the pawl 54" is received within the elongated slot 66" of the inertia element 46".

In operation, when the door 12' is opened via one of the inside and outside door handles during normal operation (so that the relative acceleration of the latch pawl 96 is below a predetermined threshold), the latch pawl 96 rotates clockwise in the direction of arrow E, as shown in FIG. 11. The inertia element 46' rotates in the direction of arrow E at approximately the same rate as the latch pawl 96 so that the pawl 54", whose pawl pin 62" remains at the first end 68" of the elongated slot 66", clears the plurality of teeth 40" disposed along the base 74", as shown in FIG. 12. Thus, the rotation of the latch pawl 96 about the pivot pin 98 is unimpeded. As a result, the ratchet 88 is allowed to rotate about the pivot pin 94 and release the striker 92 in order to allow opening of the door 12".

On the other hand, when the latch pawl 96 moves with acceleration above the pre-determined threshold, such as may occur during a motor vehicle impact, the rotation of the inertia element 46" in the direction of arrow E, shown in FIG. 11, will lag behind that of the latch pawl 96 so that the pawl pin 62" moves toward the second end 70" of the elongated slot 66" and the engaging portion 58" of the pawl 54" engages one of the plurality of teeth 40", as shown in FIG. 13. When the pawl 54" engages one of the plurality of teeth 40", further rotation of the latch pawl 96 in the direction of arrow E is prevented. As a result, the ratchet 88 remains in the latched position retaining the striker 92.

Figure 14:
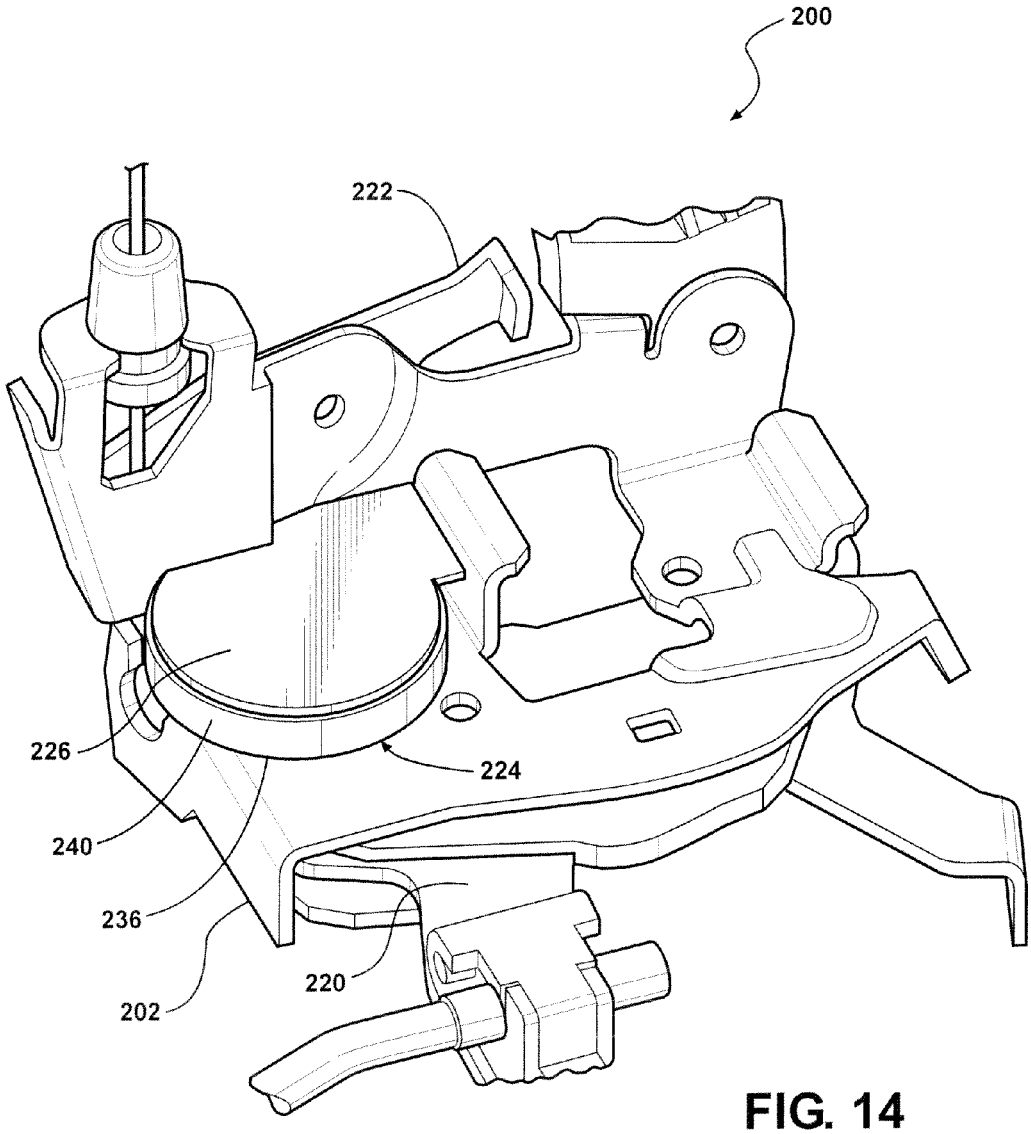
FIG. 14 is a fragmentary perspective view of a latch including a base plate and a locking device in another embodiment mounted thereto.
Figure 15:
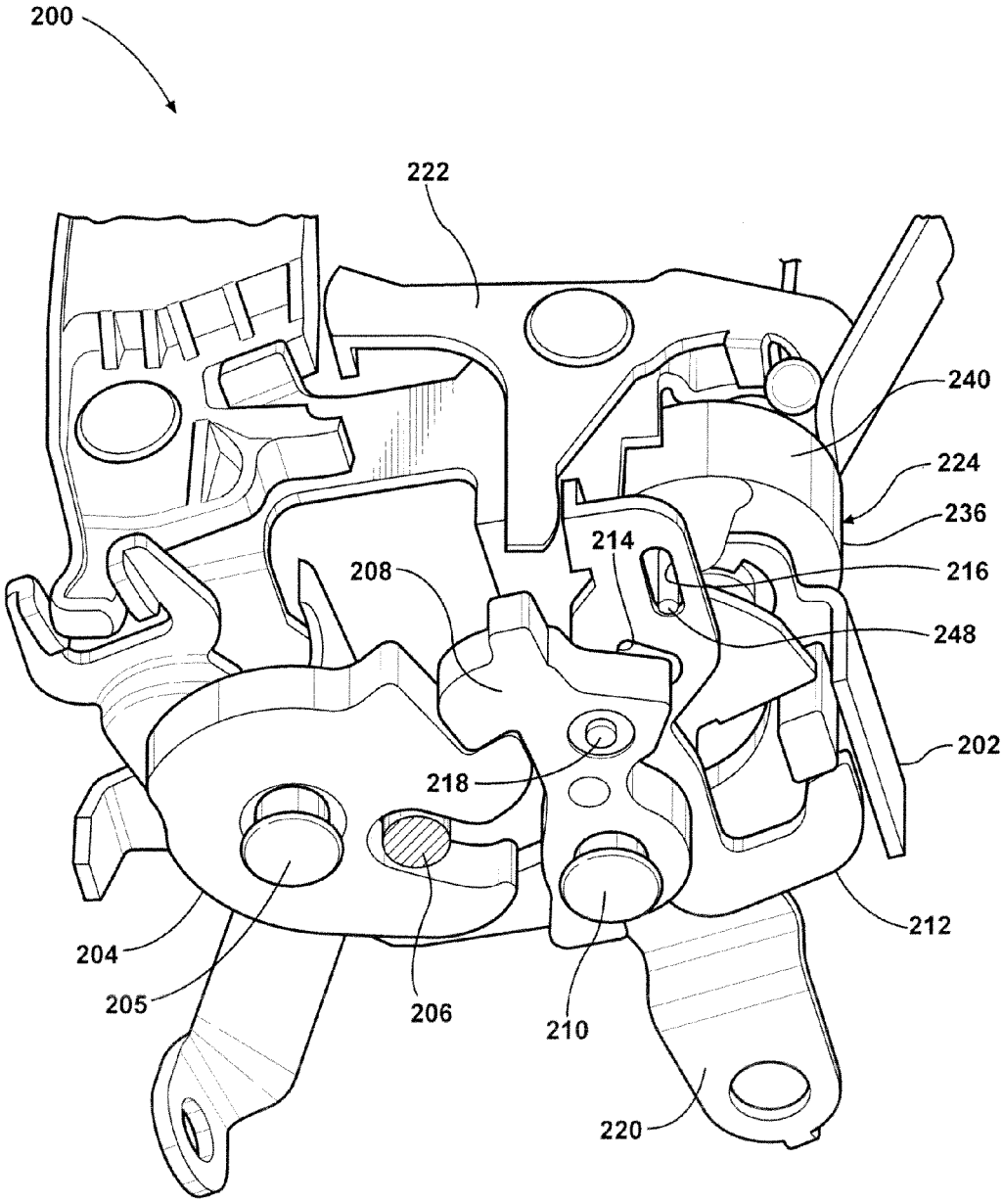
FIG. 15 is a fragmentary perspective view of the latch including a ratchet, a pawl for releasing the ratchet, and an auxiliary pawl lever operably coupled to the pawl.
Figure 16:
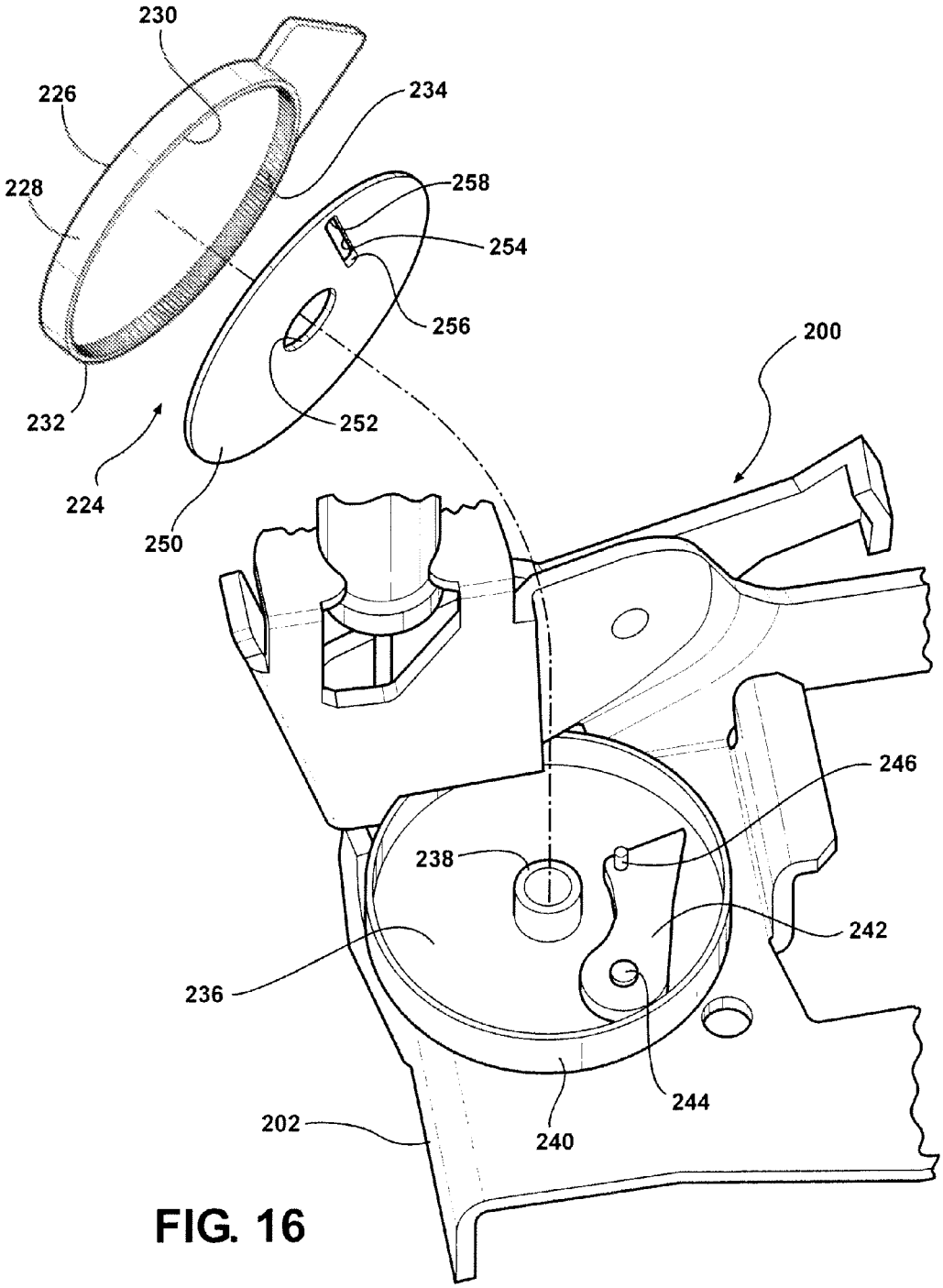
FIG. 16 is an exploded perspective view of the locking device including a lock cup, a spool, and an inertia element.
Figure 17:
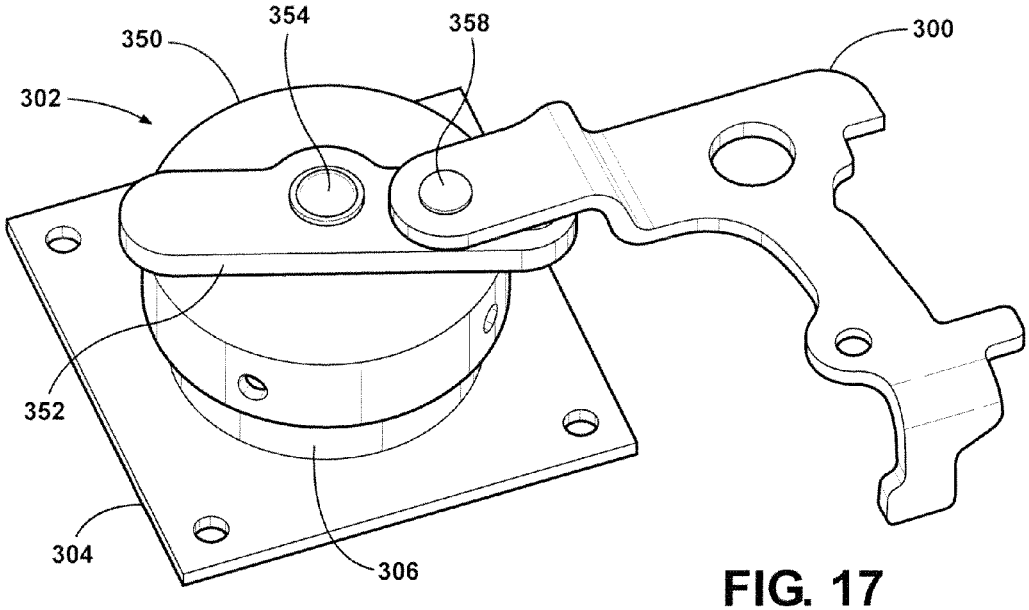
FIG. 17 is a perspective view of a locking device in another embodiment operably coupled to an auxiliary pawl lever.
Figure 18:
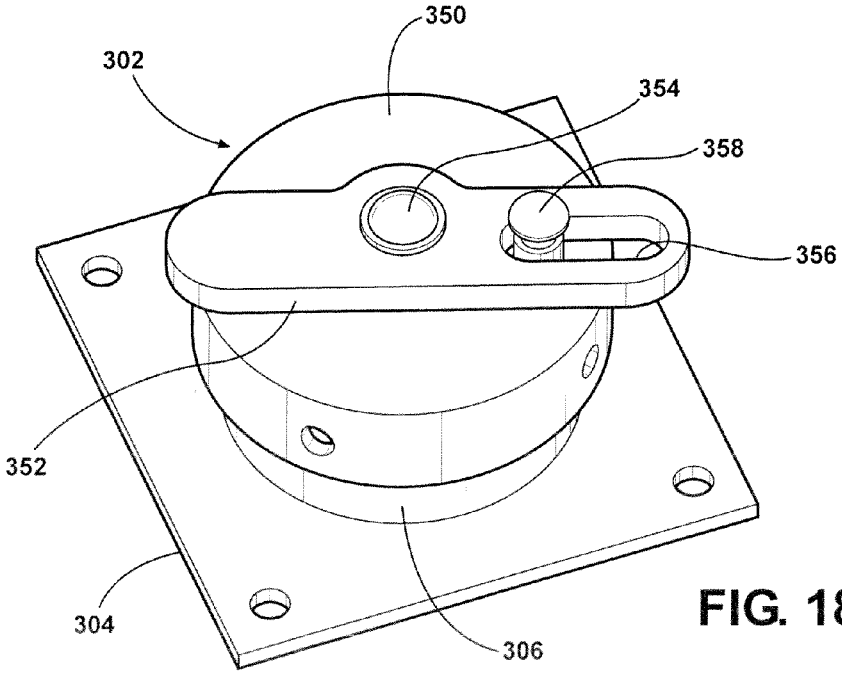
FIG. 18 is a perspective view of the locking device including a lock cup covered by a cap.

Referring to FIGS. 14 through 16, a latch, generally shown at 200, includes a base plate 202. A ratchet 204 is rotatably mounted to the base plate 202 about a pivot 205 for selectively retaining a striker 206. A pawl 208 is rotatably mounted to the base plate 202 about a pivot 210. The pawl 208 is movable between an engaged position (as shown in FIG. 15) in which the pawl 208 abuts the ratchet 204 to prevent the ratchet 204 from releasing the striker 206, and a release position in which the pawl 208 is out of engagement with the ratchet 204 and the ratchet 204 is allowed to release the striker 206. The pawl 208 is biased towards the engaged position by a spring (not shown).

The latch 200 includes an auxiliary pawl lever 212 rotatably mounted to the base plate 202. The auxiliary pawl lever 212 includes a central slot 214 and an outer slot 216. The central slot 214 receives one end of a pin 218 therethrough. The other end of the pin 218 is fixedly secured to the pawl 208 such that the auxiliary pawl lever 212 is operably coupled to the pawl 208. Thus, the central slot 214 provides for a one-way interface with the pawl 208 such that movement of the auxiliary pawl lever 212 moves the pawl 208 from the engaged position to the release position. An outside release lever 220 and an inside release lever 222 are coupled to the auxiliary pawl lever 212. When an outside handle or an inside handle is actuated, the outside release lever 220 or the inside release lever 222 effects movement of the auxiliary pawl lever 212. The auxiliary pawl lever 212 then moves the pawl 208 from the engaged position to the release position to allow the ratchet 204 to release the striker 206.

A rotary catch or locking device, generally indicated at 224, is provided for preventing inadvertent release of the latch 200 when an impact originated force causes the auxiliary pawl lever 212 to move with acceleration above a predetermined threshold relative to the base plate 202. The locking device 224 includes a lock cup 226 fixedly secured to the base plate 202. In one embodiment, the lock cup 226 is generally cylindrical. It is, however, appreciated that the particular shape of the lock cup 226 may vary. The lock cup 226 includes a peripheral wall 228 defining an opening 230, as shown in FIG. 16. The peripheral wall 228 includes an inner surface 232 having a plurality of teeth 234 positioned therealong.

The locking device 224 also includes a spool 236. The spool 236 has a central hub 238 that is disposed along a protrusion along the base plate 202 to allow for rotation of the spool 236 relative to the lock cup 226. The spool 236 also includes an annular wall 240 that fits around the peripheral wall 228 of the lock cup 226. An engagement pawl 242 is rotatably mounted to the spool 236 about a pivot member 244. The engagement pawl 242 includes a pin 246 extending out therefrom. The spool 236 further includes a protrusion 248 that is received within the outer slot 216 of the auxiliary pawl lever 212. Thus, movement of the auxiliary pawl lever 212 effects movement of the spool 236 relative to the lock cup 226.

The locking device 224 further includes an inertia element 250. It is appreciated that the inertia element 250 may have any one of various shapes. The inertia element 250 is disposed between the lock cup 226 and the spool 236. More specifically, the inertia element 250 is sized to fit inside the opening 230 defined by the peripheral wall 228 of the lock cup 226. The inertia element 250 also includes a central aperture 252 for receiving the central hub 238 of the spool 236 therethrough. Thus, the inertia element 250 is able to rotate with the spool 236 relative to the lock cup 226 when the auxiliary pawl lever 212 is actuated by one of the outside release lever 220 and the inside release lever 222. During normal operation, i.e., when the auxiliary pawl lever 212 is moved via the outside release lever 220 or the inside release lever 222 as a result of user actuation of the respective outside release handle or inside release handle, the inertia element 250 and the spool 236 rotate together relative to the lock cup 226. By contrast, when the auxiliary pawl lever 212 moves with acceleration above the predetermined threshold, such as may occur during a motor vehicle impact, rotation of the inertia element 250 lags behind the rotation of the spool 236.

The inertia element 250 further includes an elongated slot 254 having first 256 and second 258 ends. The pin 246 of the engagement pawl 242 is received within the elongated slot 254 and is movable between first 256 and second 258 ends thereof.

In operation, when the auxiliary pawl lever 212 moves with acceleration below the predetermined threshold, such as would occur during normal operation when a user actuates the outside release handle or inside release handle to move the outside release lever 220 or inside release lever 222, the auxiliary lever 212 will pivot and cause rotation of the spool 236 via the protrusion 248. The inertia element 250 rotates with the spool 236 and the pin 246 does not move towards the second end 258 of the elongated slot 254, and the engagement pawl 242 does not engage the plurality of teeth 234. As a result, the auxiliary pawl lever 212 continues to rotates and urges the pawl 208 out of the engaged position to release the ratchet 204. As a result, the ratchet 204 releases the striker 206.

On the other hand, when an impact originated force causes the auxiliary pawl lever 212 to move with acceleration above the predetermined threshold, the inertia element 250 does not rotate with the spool 236 but instead lags behind the rotation thereof. This causes the protrusion 248 to move towards the second end 258 of the elongated slot 254. Such movement of the protrusion 248 causes the engagement pawl 242 to engage one of the plurality of teeth 234 along the peripheral wall 228 of the lock cup 226. As a result, rotation of the spool 236 relative to the lock cup 226 is stopped and the auxiliary pawl lever 212 is prevented from moving the pawl 208 out of the engaged position. The ratchet 204 therefore continues to retain the striker 206.

Referring to FIGS. 17 through 23, an auxiliary pawl lever 300 effects movement of a pawl (not shown) from an engaged position to a release position upon actuation of an inside release handle or an outside release handle. A locking device, generally indicated at 302, is operably coupled to the auxiliary pawl lever 300 to prevent the auxiliary pawl lever 300 from moving the pawl when the auxiliary pawl lever 300 travels at an acceleration above a pre-determined threshold.

Figure 19:
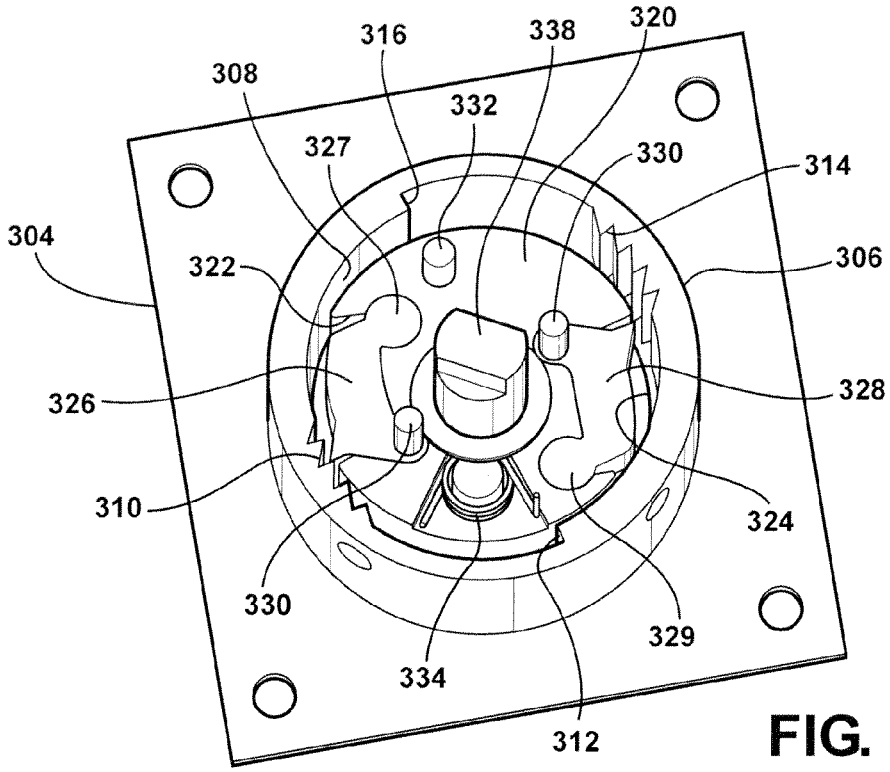
FIG. 19 is a perspective view of the locking device including a spool disposed within the lock cup and having recesses for receiving catch pawls therein.
Figure 20:
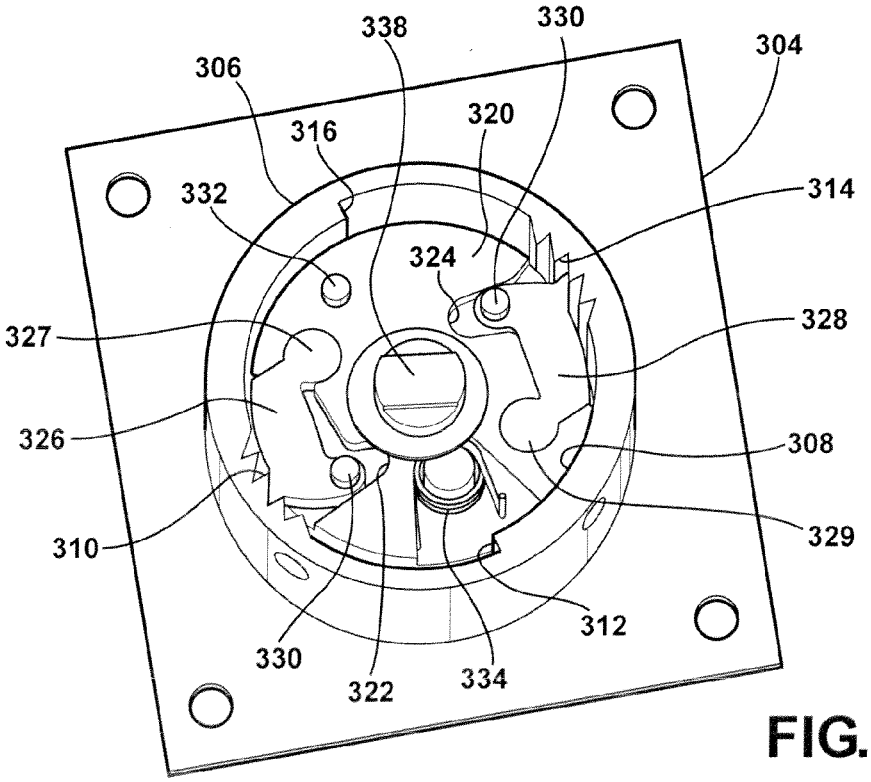
FIG. 20 is a perspective view of the locking device including the catch pawls engaging a plurality of teeth formed on the lock cup.

Referring to FIGS. 19 and 20, the locking device 302 includes a plate 304 adapted to be fixedly secured to a portion of a part or component. A lock cup 306 is fixedly secured to the plate 304 and defines an opening 308. The lock cup 306 includes a first plurality of teeth 310 and a first slot 312 adjacent to the first plurality of teeth 310. The lock cup 306 also includes a second plurality of teeth 314 and a second slot 316 adjacent to the second plurality of teeth 314.

The locking device also includes a spool 320 disposed within the opening 308 of the lock cup 306 and rotatable relative thereto. The spool 320 includes recesses 322, 324. Catch pawls 326, 328 are disposed within the respective recesses 322, 324. Each catch pawl 326, 328 includes a mounting head 327, 329 that fits within a corresponding space in the respective recesses 322, 324 to allow for pivoting movement of the catch pawls 326, 328 relative to the spool 320. Each catch pawl 326, 328 includes a catch pin 330 extending out therefrom. The spool 320 also includes a limit pin 332 extending out therefrom at a location spaced apart from the catch pawls 326, 328. A bias spring 334 is disposed along the spool 320 and includes one end fixedly secured thereto.

Figure 21:
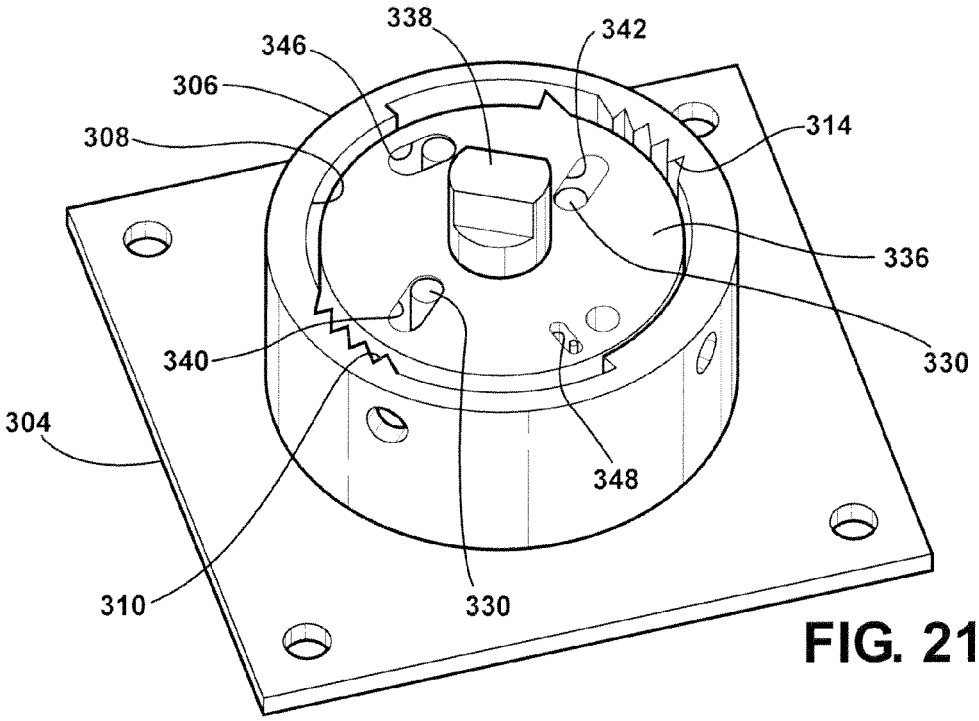
FIG. 21 is a perspective view of the locking device including an inertia element disposed within the lock cup and including slots for receiving catch pins extending out from the spool.
Figure 22:
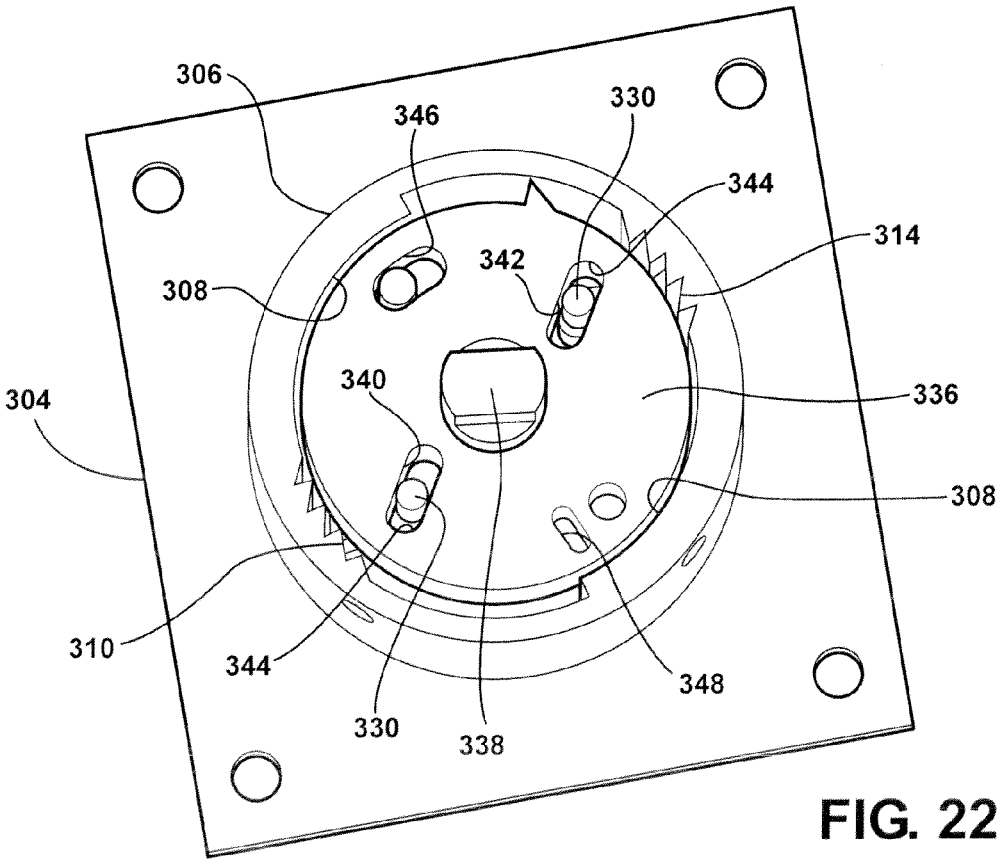
FIG. 22 is a perspective view of the locking device including the inertia element wherein the catch pins are disposed at an outboard end of said slots such that the catch pawls engage the plurality of teeth.
Figure 23:
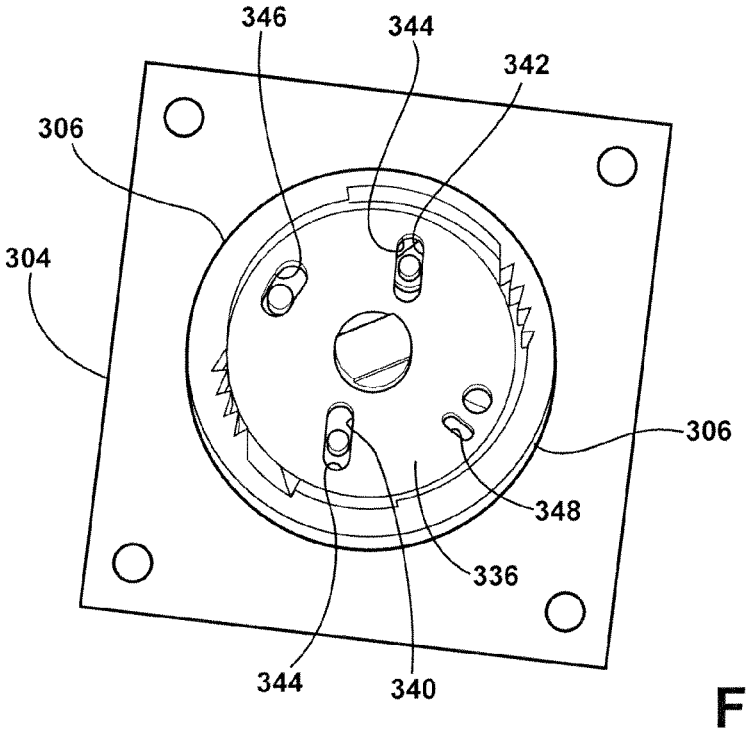
FIG. 23 is a perspective view of the locking device including the inertia element and the spool disposed within the lock cup.

Referring to FIGS. 21 through 23, the locking device 302 further includes an inertia element 336. In one embodiment, the inertia element 336 is an inertia element. It is, however, appreciated that the inertia element 336 may have any one of various shapes. The inertia element 336 is disposed within the opening 308 of the lock cup 306 and receives a central hub 338 of the spool 320 therethrough. Thus, the inertia element 336 is able to rotate with the spool 320 relative to the lock cup 306 when the auxiliary pawl lever 300 is actuated by one of the outside or inside release handles. The inertia element 336 includes a pair of catch slots 340, 342 each including a distal end 344. Each of the catch slots 340, 342 receives one of the catch pins 330 therein. The inertia element 336 also includes a stop slot 346 for receiving the limit pin 332 therewithin. The inertia element 336 further defines a slot 348 that receives one end of the bias spring 334 for biasing the inertia element 336 against the limit pin 332 on the spool 320.

The locking device 302 also includes a cap 350 that closes the opening 308 of the lock cup 306. A lever 352 is mounted to the cap 350 via a pivot member 354. The pivot member 354 is fixedly secured to the central hub 334 such that rotational movement of the lever 352 rotates the spool 320 and the inertia element 336. The lever 352 defines a slot 356 that receives an auxiliary pin 358 extending out from the auxiliary pawl lever 300.

During normal operation, i.e., when the auxiliary pawl lever 300 is moved via user actuation of the outside release handle or the inside release handle, the lever 352 rotates and causes the spool 320 and the inertia element 336 to rotate together at the same rate relative to the lock cup 308. By contrast, when the auxiliary pawl lever 300 moves with acceleration above the predetermined threshold, such as may occur during a motor vehicle impact, rotation of the inertia element 336 lags behind the rotation of the spool 320.

In operation, when either the outside release handle or the inside release handle is actuated by a user, the auxiliary pawl lever 300 rotates about the pivot member 354. This causes the spool 320 to rotate relative to the lock cup 308. The inertia element 336 rotates at approximately the same rate as the spool 320 so that the catch pawls 330 do not move to the distal end 344 of the catch slots 340, 342. The auxiliary pawl lever 300 is thus allowed to move the pawl out of the engaged position to the release position.

On the other hand, when the auxiliary pawl lever 300 moves with acceleration above the pre-determined threshold, such as may occur during a motor vehicle impact, the rotation of the inertia element 336 lags behind that of the spool 320 so that the catch pawls 330 move to the distal end 344 of the catch slots 340, 342. As a result, the catch pawls 326, 328 engage the respective first 310 and second 312 plurality of teeth. The auxiliary pawl lever 300 is prevented from further pivotal movement and is not able to move the pawl from the engaged position to the release position.

The invention has been described in an illustrative manner, and it is to be understood that the terminology, which has been used, is intended to be in the nature of words of description rather than of limitation. Many modifications and variations of the present invention are possible in light of the above teachings. It is, therefore, to be understood that within the scope of the appended claims, the invention may be practiced other than as specifically described.

What is claimed:

1. A locking device for a handle assembly of a motor vehicle door including a base and a handle portion, said locking device comprising:

a lock cup fixedly secured to the base and having a plurality of teeth;

a spool rotatably coupled to said lock cup and operably connected to the handle portion, said spool having a pawl rotatably mounted thereto, said pawl including a pawl pin extending out therefrom;

an inertia element disposed within said lock cup and rotatable out of a rest position upon rotation of said spool, said inertia element including an elongated slot extending between first and second ends for receiving said pawl pin therewithin; and a spring extending between said spool and said inertia element, said spring biasing said inertia element towards said rest position;

whereby upon acceleration of the handle assembly below a predetermined threshold said inertia element rotates with said spool and the handle portion moves relative to the base to allow opening of the door, and upon acceleration of the handle assembly above the predetermined threshold said inertia element lags rotation of said spool and forces said pawl pin to said second end of said elongated slot to urge said pawl into engagement with one of said plurality of teeth on said lock cup to stop movement of the handle portion relative to the base and prevent the door from opening.

2. A locking device as set forth in claim 1 wherein said spool includes a slot for receiving a portion of the handle assembly therethrough to operatively connect said spool with the handle portion.

3. A locking device as set forth in claim 1 wherein said spool includes first and second stops disposed therealong.

4. A locking device as set forth in claim 3 wherein said inertia element includes an abutment member engageable with said first and second stops to limit rotational movement of said inertia element.

5. A locking device as set forth in claim 1 wherein said pawl is disposed between said inertia element and said spool.

6. A handle assembly for actuating a door latch mechanism of a motor vehicle door, said handle assembly comprising:

a base adapted to be fixedly secured to the door;

a handle portion pivotally secured to said base and operatively connected to the door latch mechanism;

a lock cup fixedly secured to said base and having a plurality of teeth;

a spool rotatably coupled to said lock cup and operably connected to said handle portion, said spool having a pawl rotatably mounted thereto, said pawl including a pawl pin extending therefrom;

an inertia element disposed within said lock cup and rotatable out of a rest position upon rotation of said spool, said inertia element including an elongated slot extending between first and second ends for receiving said pawl pin therewithin; and a spring extending between said spool and said inertia element, said spring biasing said inertia element towards said rest position;

whereby upon acceleration of said handle portion below a predetermined threshold said inertia element rotates with said spool and said pawl remains spaced apart from said second end of said elongated slot such that the handle portion moves relative to the base and the door latch mechanism is released, and upon acceleration of said handle portion above the predetermined threshold said inertia element lags rotation of said spool and forces said pawl to said second end of said elongated slot into engagement with one of said plurality of teeth to stop movement of said handle portion relative to said base and prevent the door from opening.

7. A handle assembly as set forth in claim 6 wherein said handle portion includes a pin extending out therefrom.

8. A handle assembly as set forth in claim 7 wherein said spool includes a slot for receiving said pin to operatively connect said spool with the handle portion.

9. A handle assembly as set forth in claim 6 wherein said spool includes first and second stops disposed therealong.

10. A handle assembly as set forth in claim 9 wherein said inertia element includes an abutment member engageable with said first and second stops to limit rotational movement of said inertia element.

11. A handle assembly as set forth in claim 6 wherein said pawl is disposed between said inertia element and said spool.

12. A locking device for selectively preventing a fork rotatably mounted to a base from releasing a bolt upon movement of a door, said locking device comprising:

a plurality of teeth fixedly secured to the base adjacent the fork;

a pawl rotatably mounted to the fork and having an engaging portion, said pawl including a pawl pin extending out therefrom;

an inertia element rotatable out of a rest position upon rotation of the fork, said inertia element including an elongated slot extending between a first end and a second end for receiving said pawl pin therewithin; and a spring extending between said inertia element and the fork for biasing said inertia element towards said rest position;

whereby upon the acceleration of the door below a predetermined threshold said inertia element rotates with the fork to allow the fork to release the bolt, and upon the acceleration of the door above the predetermined threshold rotation of said inertia element lags behind rotation of the fork such that said pawl pin moves to the second end of said elongated slot to urge said engaging portion of said pawl into engagement with one of said plurality of teeth to prevent the fork from releasing the bolt.

13. A locking device as set forth in claim 12 wherein said pawl is disposed between said inertia element and the fork.

14. A locking device as set forth in claim 13 wherein said inertia element includes an abutment member engageable with a stop on the fork when said inertia element is in said rest position.

15. A door latch for a motor vehicle door, said door latch comprising:

a base;

a ratchet rotatably mounted to said base and selectively retaining a striker;

a latch pawl rotatably mounted to said base and selectively engaging said ratchet;

a plurality of teeth fixedly secured to said base;

a pawl rotatably mounted to said latch pawl, said pawl including a pawl pin extending out therefrom;

an inertia element rotatably coupled to said pawl for movement from a rest position, said inertia element including an elongated slot extending between first and second ends for receiving said pawl pin therewithin; and a spring extending between said latch pawl and said inertia element for biasing said inertia element into said rest position;

whereby upon acceleration of said latch pawl below a predetermined threshold said inertia element rotates simultaneously with said latch pawl and said latch pawl releases said ratchet to allow opening of the door and upon acceleration of said latch pawl above the predetermined threshold said inertia element lags rotation of said latch pawl so that said pawl pin moves to said second end of said elongated slot and said pawl engages one of said plurality of teeth to stop movement of said latch pawl and prevent the door from opening.

16. A door latch as set forth in claim 15 wherein said latch pawl includes a stop engageable with said inertia element when said inertia element is in said rest position.

17. A latch for retaining a striker, said latch comprising:

a base plate;

a ratchet rotatably mounted to said base and selectively retaining the striker;

a pawl rotatably mounted to said base and movable between an engaged position in engagement with said ratchet and a release position spaced apart from said ratchet to release the striker;

an auxiliary pawl lever operably coupled to said pawl for selectively moving said pawl from said engaged position to said release position; and a locking device including a lock cup fixedly mounted to said base plate and having a plurality of teeth, a spool rotatably mounted to said lock cup, an inertia element rotatable with said spool, and an engagement pawl rotatably mounted between said spool and said inertia element such that upon acceleration of said auxiliary pawl lever below a predetermined threshold said inertia element rotates together with said spool to allow said auxiliary pawl lever to move said pawl from said engaged position to said release position, and upon acceleration of said auxiliary pawl lever above the predetermined threshold said inertia element lags rotation of said spool so that said engagement pawl engages one of said plurality of teeth to stop movement of said auxiliary pawl lever and prevent movement of said pawl from said engaged position to said release position.

18. A latch as set forth in claim 17 wherein said spool includes a protrusion extending out therefrom.

19. A latch as set forth in claim 18 wherein said auxiliary pawl lever includes an outer slot for receiving said protrusion therewithin.

20. A latch as set forth in claim 17 wherein said engagement pawl includes a pin extending out therefrom.

21. A latch as set forth in claim 20 wherein said inertia element includes an elongated slot extending between first and second ends for receiving said pin therewithin.

22. A locking device for selectively controlling rotational movement of an auxiliary pawl lever, said locking device comprising:

a lever operably coupled to the auxiliary pawl lever;

a lock cup having a peripheral wall and a plurality of teeth disposed along said peripheral wall;

a spool coupled to said lever and rotatable relative to said lock cup, said spool defining first and second recesses, said spool including first and second catch pawls received within said first and second recesses and rotatable relative to said spool, each of said first and second catch pawls including a catch pin extending out therefrom;

an inertia element rotatable with said spool, said inertia element including catch slots each receiving one of said catch pins therewithin such that upon acceleration of said auxiliary pawl lever below a predetermined threshold said inertia element rotates together with said spool to allow said auxiliary pawl lever to move said pawl from said engaged position to said release position, and upon acceleration of said auxiliary pawl lever above the predetermined threshold said inertia element lags rotation of said spool so that said catch pawls engage said plurality of teeth on said lock cup to stop movement of said auxiliary pawl lever and prevent movement of said pawl from said engaged position to said release position.

23. A locking device as set forth in claim 22 wherein each of said first and second catch pawls includes a mounting head sized to fit within a corresponding space in said first and second recesses to allow for pivotal movement of said first and second catch pawls relative to said spool.

24. A locking device as set forth in claim 23 wherein said spool includes a limit pin extending out therefrom.

25. A locking device as set forth in claim 24 wherein said inertia element includes a limit slot for receiving said limit pin such that movement of said limit pin to one end of said slot places said inertia element in a rest position.

26. A locking device as set forth in claim 25 including a spring extending between said spool and said inertia element for biasing said inertia element towards said rest position.

* * * * *